US010471364B2

(12) United States Patent
Deutsch

(10) Patent No.: US 10,471,364 B2
(45) Date of Patent: Nov. 12, 2019

(54) BENDABLE AND RAISABLE TOY TRACK

(71) Applicant: David Deutsch, Brooklyn, NY (US)

(72) Inventor: David Deutsch, Brooklyn, NY (US)

( * ) Notice: Subject to any disclaimer, the term of this patent is extended or adjusted under 35 U.S.C. 154(b) by 0 days.

(21) Appl. No.: 15/261,075

(22) Filed: Sep. 9, 2016

(65) Prior Publication Data

US 2018/0071647 A1 Mar. 15, 2018

(51) Int. Cl.

| | |
|---|---|
| ***A63H 18/02*** | (2006.01) |
| ***A63H 18/04*** | (2006.01) |
| ***E01B 25/00*** | (2006.01) |
| ***A63H 19/30*** | (2006.01) |

(52) U.S. Cl.

CPC ..... *A63H 18/021* (2013.01); *A63H 18/04* (2013.01); *A63H 19/30* (2013.01); *E01B 25/00* (2013.01)

(58) Field of Classification Search

CPC ..... A63H 18/02; A63H 18/021; A63H 18/04; E01B 25/00

See application file for complete search history.

(56) References Cited

U.S. PATENT DOCUMENTS

| | | | | |
|---|---|---|---|---|
| 2,574,067 | A * | 11/1951 | Seidman | A63H 18/02 238/10 C |
| 4,217,727 | A * | 8/1980 | Fetty | A63H 18/021 104/120 |
| 6,631,850 | B1 * | 10/2003 | Wa | A63H 18/021 104/60 |
| 2004/0077256 | A1 * | 4/2004 | Laferrera | A63H 33/12 446/85 |
| 2010/0330867 | A1 * | 12/2010 | Fogel | A63H 33/062 446/124 |
| 2011/0081825 | A1 * | 4/2011 | Jourdian | A63H 18/02 446/444 |
| 2017/0087478 | A1 * | 3/2017 | Daly | A63H 33/086 |
| 2018/0071647 | A1 * | 3/2018 | Deutsch | A63H 18/021 |

* cited by examiner

*Primary Examiner* — Jason C Smith
(74) *Attorney, Agent, or Firm* — Michael J. Feigin, Esq.; Feigin & Fridman LLC

(57) ABSTRACT

A train track of embodiments of the disclosed technology is bendable in a vertical and/or horizontal plane. This is accomplished by having connectors on either side of two rails which can change in length. The rail, between the connectors, is bendable. Further, a hinged top of a block is used to attach the track to the block when the angle of the lower side changes in combination with an elevation change.

19 Claims, 13 Drawing Sheets

BENDABLE AND RAISABLE TOY TRACK

FIELD OF THE DISCLOSED TECHNOLOGY

The disclosed technology relates generally to train tracks, and, more specifically, to flexible train tracks.

BACKGROUND

Train tracks are generally two parallel lengths of material over which a vehicle travels. This works well for fixed position tracks which are generally built in place, but when one wants to be able to move the track, this is usually not possible without adhering to very rigid placement. Even in the case of toy tracks, which a child can pick up and put back down in a different place, one has to select pre-shaped pieces, which are of rigid form, and figure out how to fit them all into place. Anyone who has ever built a train track layout with a son or daughter and tried to build, for example, a figure eight, knows that the figure eight will end up perfectly symmetrical or adhere to some other fixed length guidelines. If one tries to vary the design by adding a longer piece somewhere, another corresponding longer piece will be necessary. Otherwise, the builder will find quite soon, and to his or her disappointment, that the last piece will not fit in where one wants it.

Further, train track sets for children often come with bridges. One can raise and lower the elevation of the track by using a specially designed piece to do so. This works well, but again, is very rigid. A typical train set might come with one bridge for every two dozen or so flat pieces, which limits creativity or causes a lot of unnecessary waste, in order to have enough of every type of piece to build what is desired. Whereas, for example, a set of blocks has a less rigid structure and many more configurations, train tracks are usually fairly limited in the number of combinations by orders of magnitude less.

What is needed in the art is a way to increase the number of permutations which can be built with a train track, while decreasing the number of different types of pieces needed. While these needs are often contradictory, such a decrease would enable one to procure a train set at a lower price, while at the same time having a better toy with which to build many more creations.

SUMMARY OF THE DISCLOSED TECHNOLOGY

A track movable in the horizontal and/or vertical axis has two bendable and resilient rails. "Bendable" is defined as being able to change shape without breaking, and "resilient" is defined as being able to return to the original shape before it was bent. Two non-bendable ties are transverse to, and fixed to, the two rails, at least at either end. An "end" is a portion where the material changes from the bendable track to incorporate other elements used in changing the size of, and/or length of, the rail. A "middle" is a portion where this is a rail without elements used to change the size of, and/or length of, the rail. These definitions are for the purpose of explaining the embodiments shown and should not be construed as limiting, as one could add further size-changing mechanisms in the "middle" of the track shown in the figures.

A first sliding member is fixedly attached to a first of two of the rails and is slidably engaged with a first of the two ties. A second sliding member is fixedly attached to a second of the rails and is slidably engaged with a second of the two ties. An uninterrupted space can be created between the two rails and the two ties. The first and second sliding members can each have a male connector which is removably engageable with a female connector. The female connector can be on an end opposite a respective sliding member.

A bottom side of each of the two ties is removably attached to a support surface, such as a peg board, board with divets or externally facing bumps, or block, in embodiments of the disclosed technology. This causes each sliding member to be fixed in position with the track bent accordingly. Upon a first side of the track extending in length, a second side of the track decreases in length as a function of the increasing of the first side of the track, in embodiments of the disclosed technology. When bent, an acute bend is formed in the track, with the second side being on an inside of the bend in the track (each rail is bent at a different angle, but the rails remain equi-spaced from each other throughout their length).

The track can be a part of a kit with a block. A first of the ties is removably engaged with a top section of the block, and the top section of the block can be hingedly connected to a body of the block. The block can be removably connected to another device beneath the track, which is in a same horizontal plane as a device removably connected to, and beneath, the second of the ties. Such a device can be a planar board with externally facing bumps at regular intervals, another block, or the like. The two rails can be bent from end to end in a horizontal plane. The two rails can change, from end to end, additionally in a vertical plane, as well as two axes of a horizontal plane.

Another way of describing a track of the disclosed technology is as two rails which are bendable, resilient, and remain equi-spaced from each other between two rails. At least one end of each rail has a movable section which allows a length of each respective rail two change. A tie connects each rail of the two rails together at either end thereof, and a connection mechanism (such as a male or female connector) is on a bottom side of each tie. Another connection mechanism can be at an end of each rail having a direction of connection which is perpendicular to a direction of connection of the connection mechanism on a bottom side of each tie. Thus, the bottom connector allows one to connect a track to the ground, and the connector perpendicular thereto allows, in embodiments, multiple lengths of track to connect to each other. The bottom side can connect into a peg board on one end and a block on another, with the block, or a series of blocks beneath further connecting into the same peg board, such as when the track changes in elevation. The track can actually change direction (from end to end) in an X and Y plane, and also a Z plane or any combination of X, Y, and Z planes, where the XZ and YZ planes are vertical (elevation) and the XY plane is horizontal.

"Substantially" and "substantially shown," for purposes of this specification, are defined as "at least 90%," or as otherwise indicated. "Identical" or "exactly," for purposes of this specification, is defined as "within an acceptable tolerance level known in the art." Any device may "comprise," or "consist of," the devices mentioned there-in, as limited by the claims. Any element described may be one of "exactly" or "substantially," as described.

It should be understood that the use of "and/or" is defined inclusively, such that the term "a and/or b" should be read to include the sets: "a and b," "a or b," "a," or "b."

DETAILED DESCRIPTION OF EMBODIMENTS OF THE DISCLOSED TECHNOLOGY

A train track of embodiments of the disclosed technology is bendable in a vertical and/or horizontal plane. This is accomplished by having connectors on either side of two rails which can change in length. The rail between the connectors is bendable. Further, a hinged top of a block is used to attach the track to the block when the angle of the lower side changes in combinaton with an elevation change.

Embodiments of the disclosed technology will become clearer in view of the following description of the figures.

Figure 1:
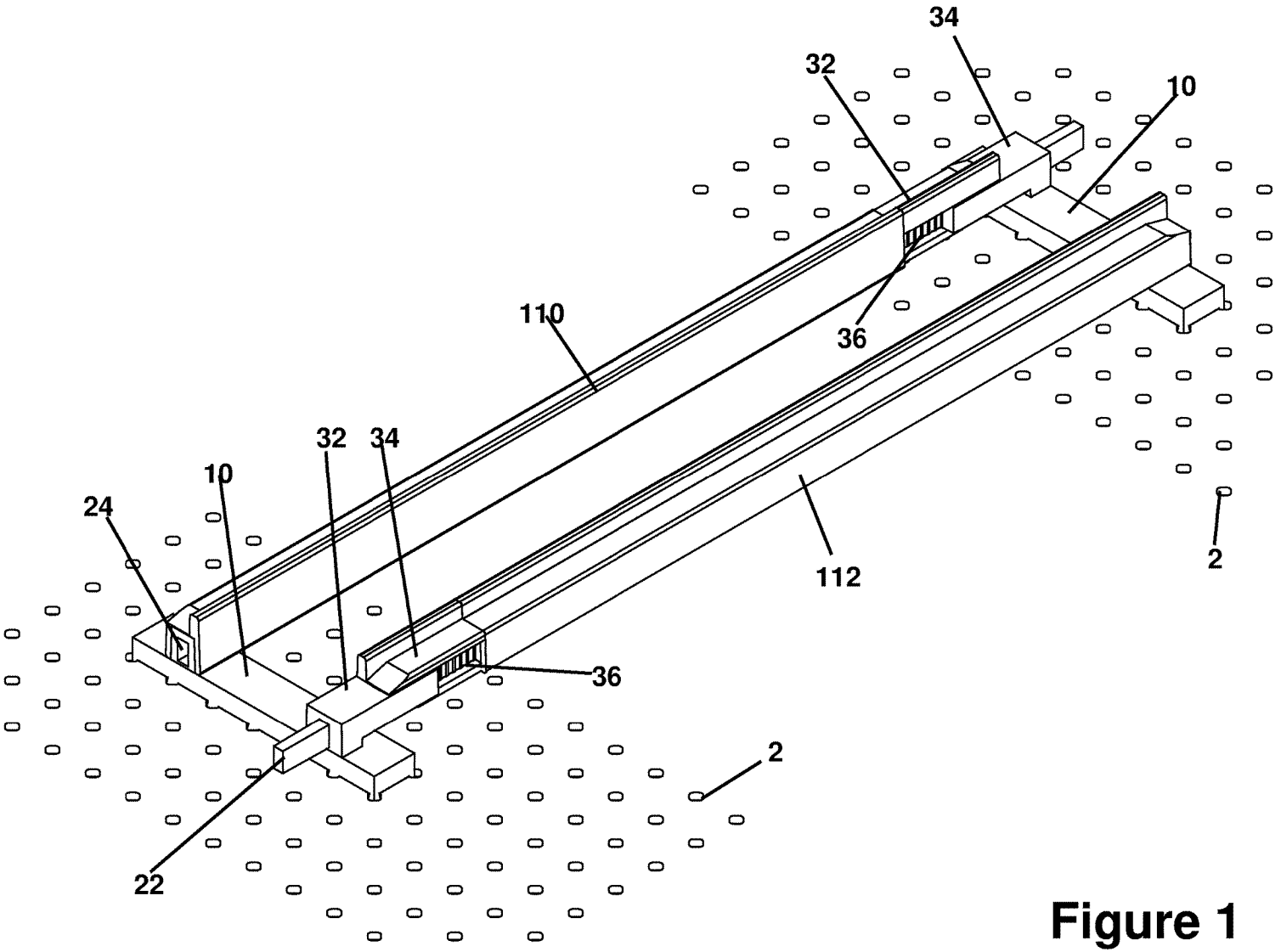
FIG. 1 shows a perspective view of a track piece used in embodiments of the disclosed technology.

FIG. 1 shows a perspective view of a track piece used in embodiments of the disclosed technology. The train track shown has two railroad rails 110 and 112 (herein referred to as "rails") which are elongated elements over which a vehicle is designed to pass along their length. The rails, in embodiments of the disclosed technology, have reflexive symmetry with one another, meaning that they are the identical piece with the same elements, except that one is connected to railroad ties 10 in an opposite orientation to the other. At the end of each rail 110/112 are a male member 22 and female member 24, such that the male and female members attach to each other to join multiple pieces of rail. As the rails 110 and 112 are oppositely disposed in embodiments of the disclosed technology, on each side of a section of track there exist a male member 22 and female member 24.

Ties 10 exist on at least each end of the track and have attachment mechanisms which allow the ties to attach to other devices, such as a pegboard 2 having corresponding female or male connectors. These ties 10 are, in embodiments of the disclosed technology, perpendicular or substantially perpendicular to their points of connection with each rail 110 and 112. When the rails 110 and 112 are bent, the ties 10 are at a less/more than a perpendicular angle with the entirety of the length of the rails 110 and 112.

On each side of a rail with a male member 22, the male member can extend outwards or retract. The male member 22 is fixed to a stationary member 32, which slides closer or further to a central section of a rail 110 or 112 (the longest stretch of uninterrupted material of a rail between the end pieces). A bumped section 36 of each rail engages with male flanges on the stationary member 32 to hold the male member in position. In the length of track shown in FIG. 1, the track is straight in both the horizontal and the vertical plane, so the stationary member 32 is in a middle position with respect to the bumped section 36. This allows the male member 22 and stationary member 32 to extend outwards (lengthening the overall length of the track) or inwards (shortening the overall length of the track). This will become important when varying the track shape in the horizontal or vertical plane. A slidable connector 34 is fixed in position with the bumped section 36, and the stationary member 32 moves with respect to the slidable connection 34. This slidable connector 34 is stationary with respect to the middle region/most elongated section of the rail 110 or 112.

For purposes of this specification, the horizontal plane refers to a same elevation, when defining the side of the ties 10 that connect into the board 2 as the "bottom," and the opposite side (a plane of the rails 110 and 112 which is furthest from the ties 10 and extends between ties 10 on either side the rail) as the "top". The vertical plane is perpendicular to the horizontal plane and refers to a change in elevation.

Figure 2:
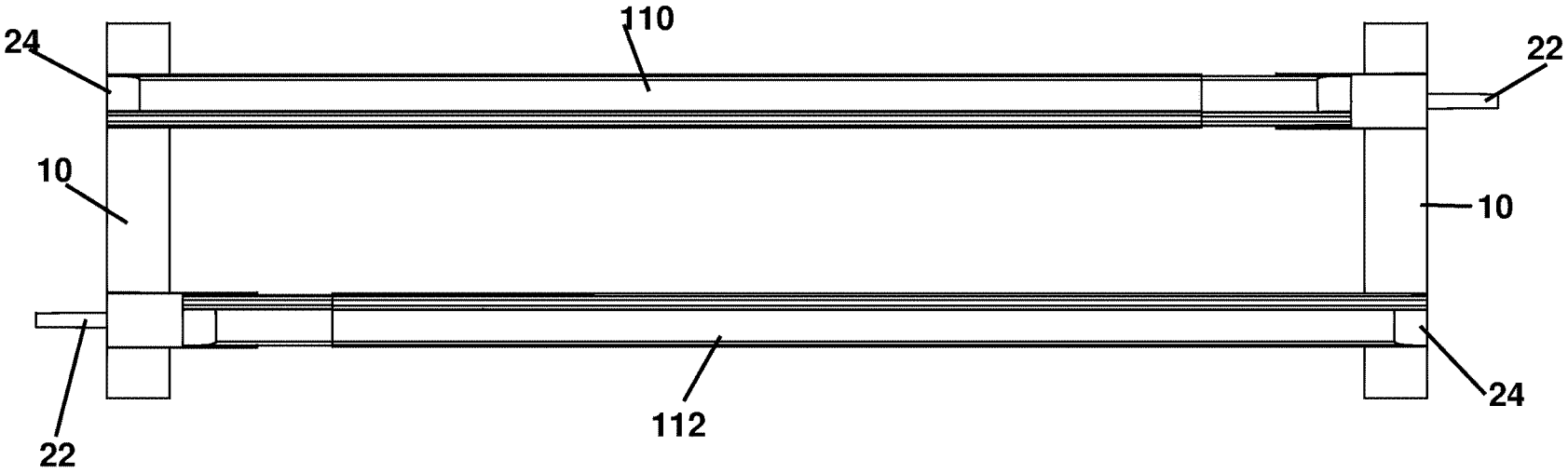
FIG. 2 shows a top plan view of the track of FIG. 1.
Figure 3:
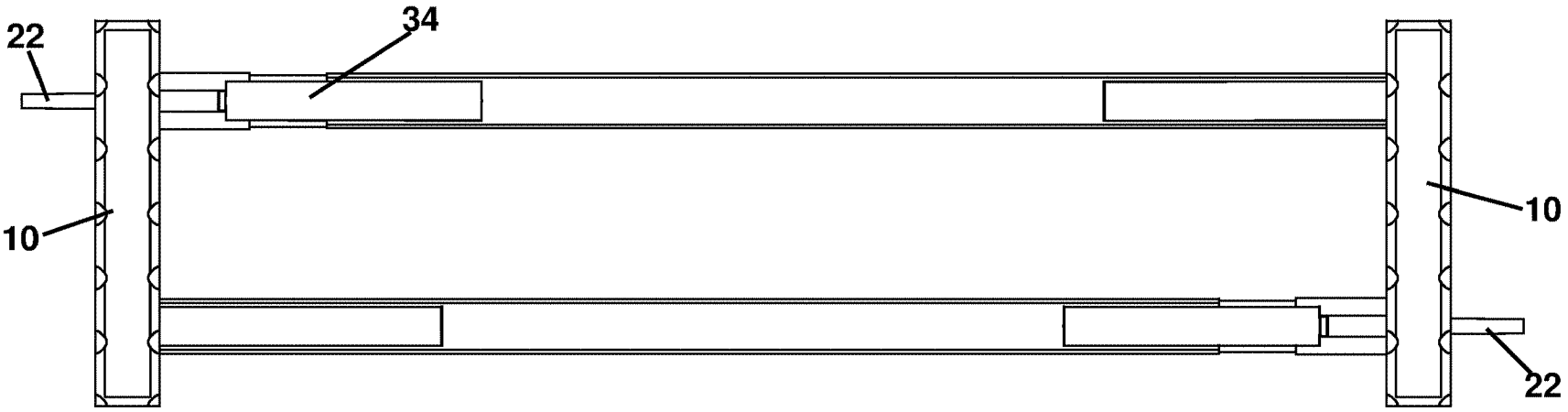
FIG. 3 shows a bottom plan view of the track of FIG. 1.
Figure 4:
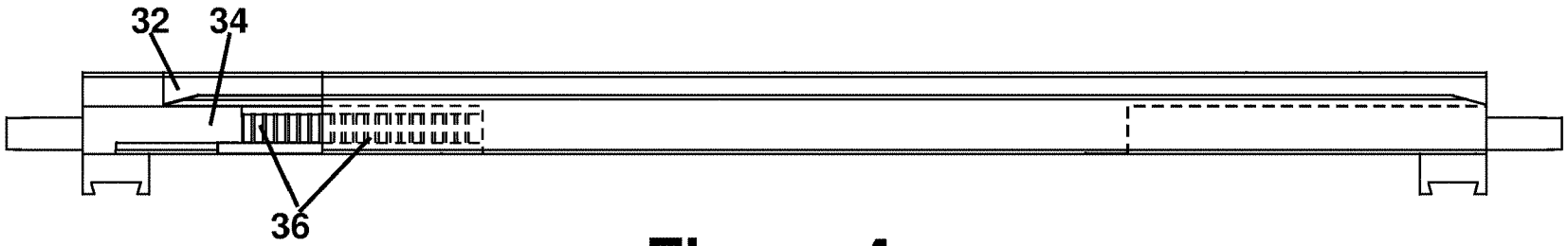
FIG. 4 shows a side elevation view of the track of FIG. 1.

FIG. 2 show a top plane view of the track of FIG. 1. FIG. 3 show a bottom plane view of the track of FIG. 1. FIG. 4 show a side elevation view of the track of FIG. 1. By viewing the combination of these figures, one can see all sides of the track. It should be understood that the track shown is by way of example, and a track of any length can be used, and one can join such tracks of different lengths, if desired. One can angle the tracks by moving a side of a tie 10 closer or further away from the middle region of a rail 110 or 112. A stationary member 32 is fixed in position to the tie 10, such that when the slidable connector 34 moves further past the stationary connector 32 and bumped section 36, the tie 10 angles such that a side of a tie 10 becomes closer to the rail 110 or 112. Both sides of the tie 10, that is, the entirety of the tie, can also be brought closer to the central region of the track by bringing a slidable member 32 closer to the central section of the rail 110 or 112 on both sides thereof.

Referring now specifically to FIG. 4, one can see the extent of the bumped region 36. Part of the bumped region is exposed (solid line) and part is hidden from view (dotted lines). In the shortest configuration of a side of a track, the bumped region 36 is entirely hidden from view, while in a longest configuration of a side of a track, the bumped region 36 is entirely or substantially visible in this side view, in some embodiments. One can thus angle a track in this manner up to 15, 30, or 35 degrees in the horizontal plane by extending the length of one side of track while shortening the length of the other side of track, depending on the precise configuration used. These different maximum angles are determined based on the geometry used, including the length of rails 110 and 112, depth of the bumped region 36, and length of the slidable region 34.

Figure 5:
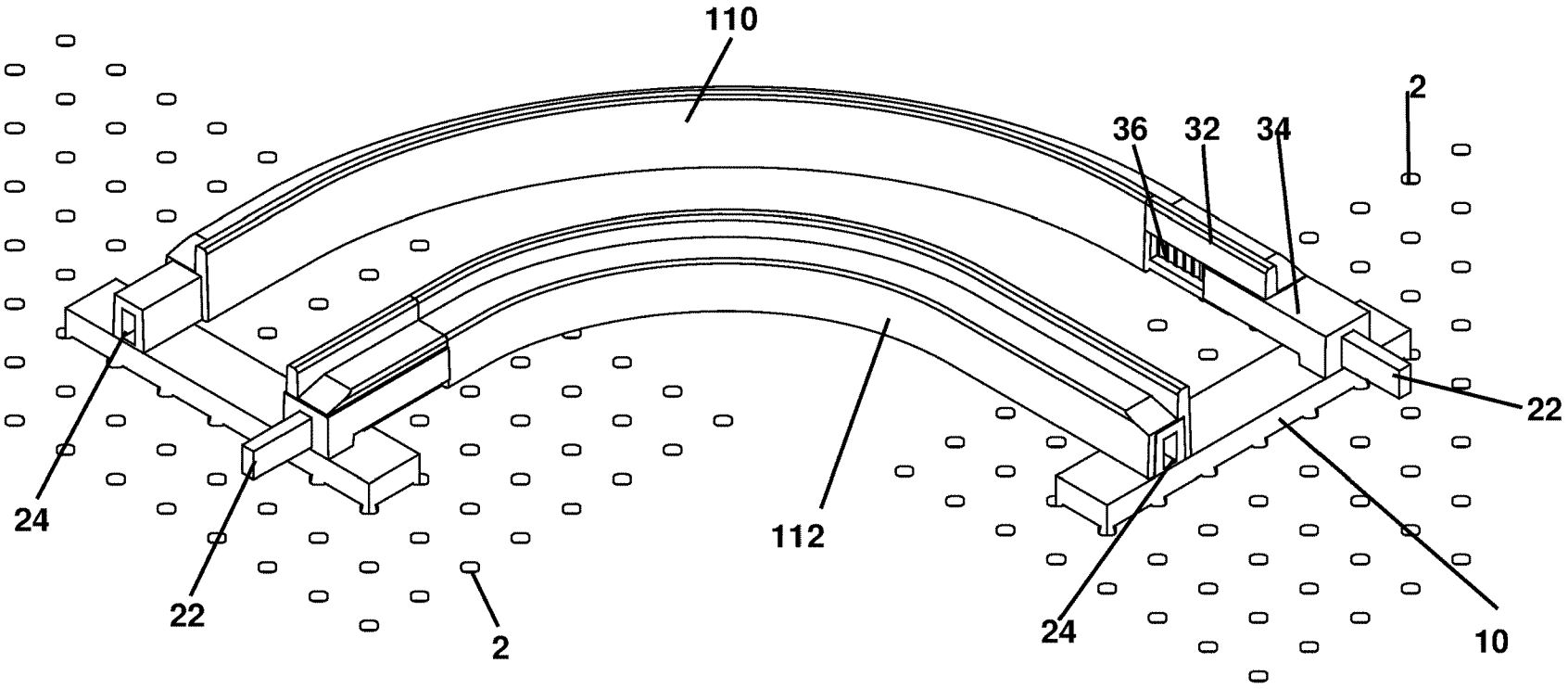
FIG. 5 shows a perspective view of the track of FIG. 1 bent in a horizontal plane 45 degrees.
Figure 6:
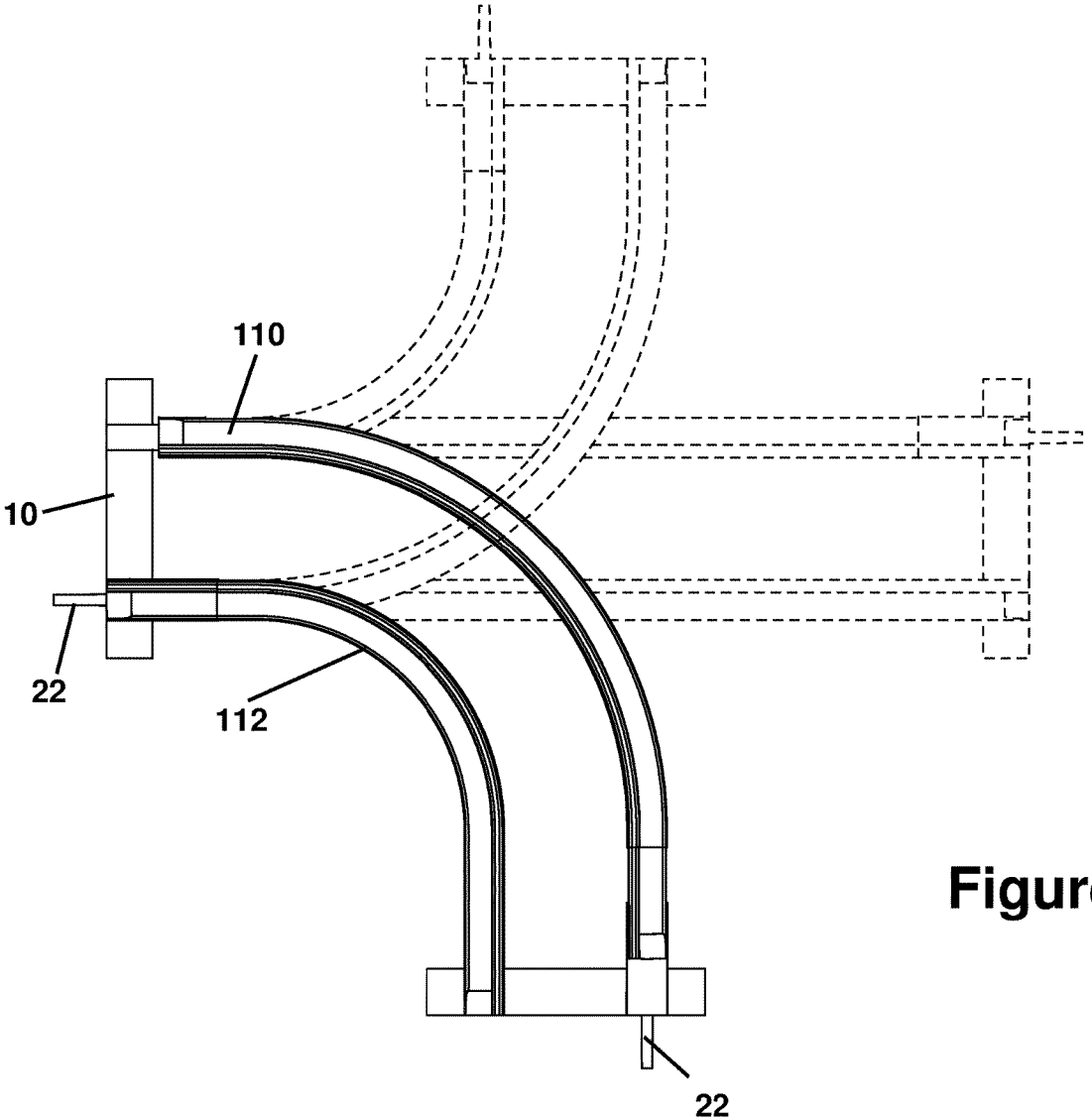
FIG. 6 shows examples of bending the track of FIG. 1 in the horizontal plane 45 degrees.

FIG. 5 shows a perspective view of the track of FIG. 1 bent in a horizontal plane 45 degrees. FIG. 6 shows examples of bending the track of FIG. 1 in the horizontal plane 45 degrees. This is accomplished by bending the rails, such that rail 112 is at the interior of rail 110. Rail 112 is decreased in length by sliding the slider 35 all the way in towards the central region of the rail, and rail 110 is increased in length by sliding the slider 34 all the way out from the central region of the track. In this manner, the same piece of track can be a straight piece of track (shown in FIG. 1) or a curved piece of track (shown in FIG. 5).

Figure 7:
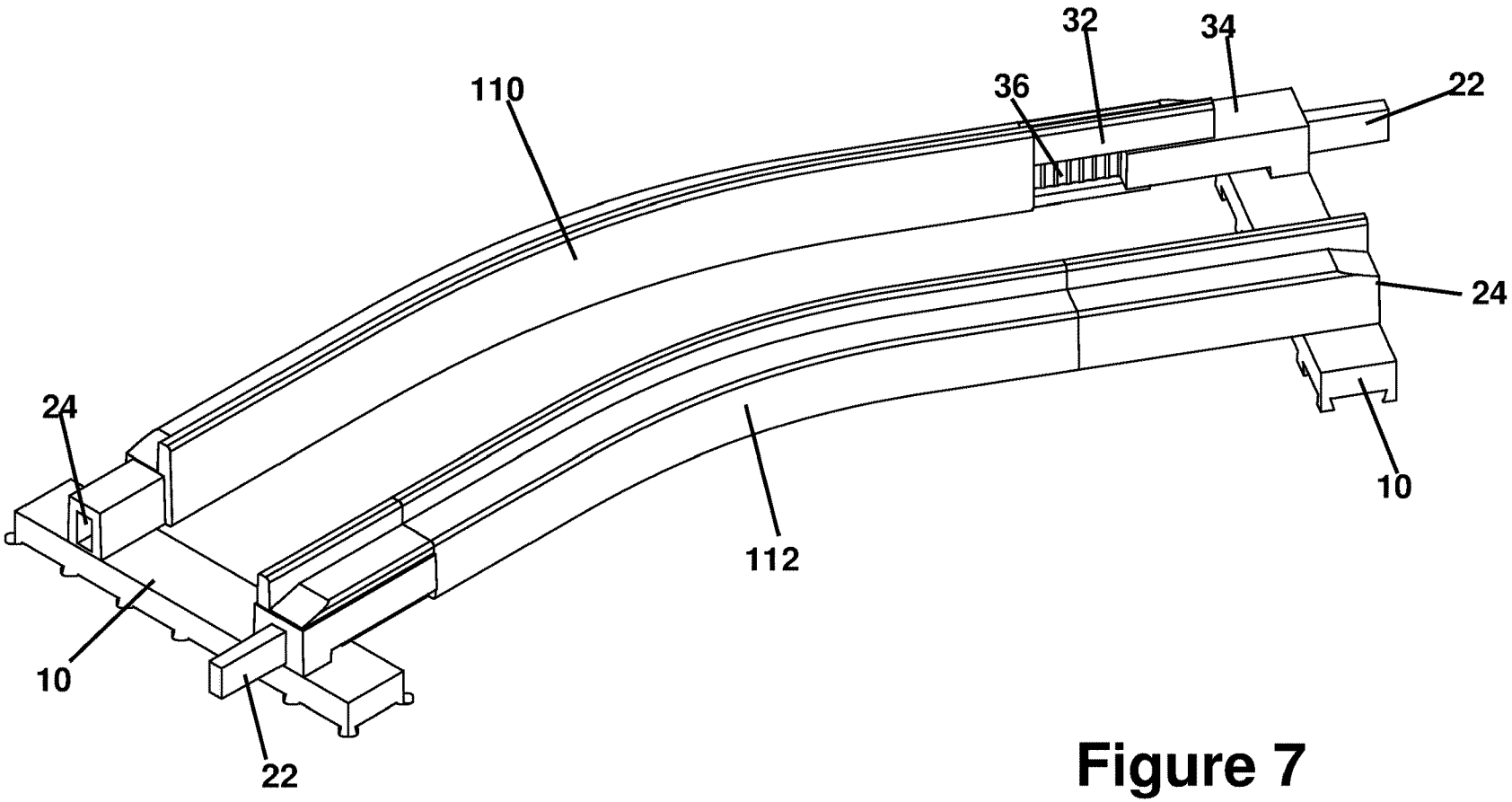
FIG. 7 shows a perspective view of the track of FIG. 1 bent in a horizontal plane 30 degrees.
Figure 8:
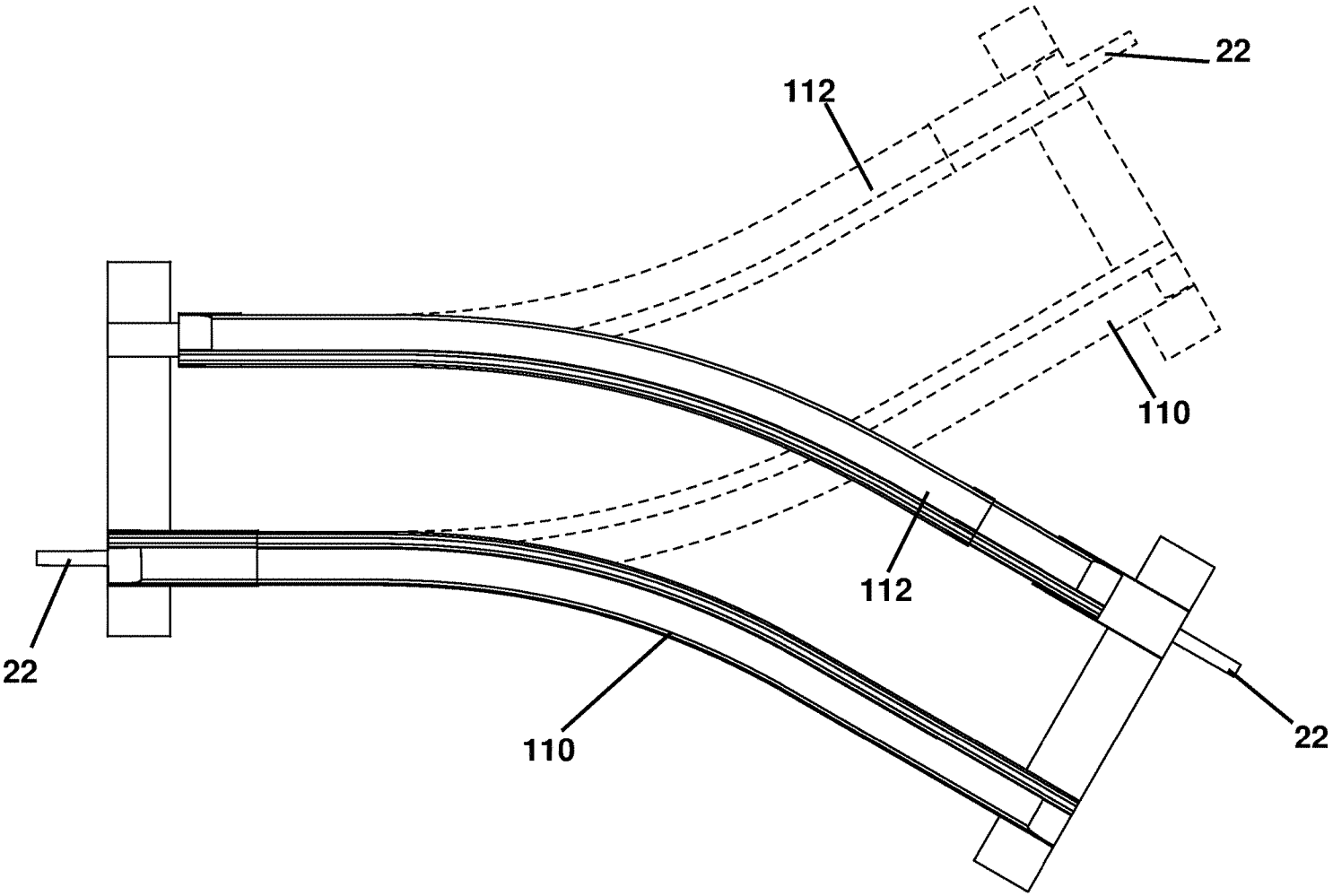
FIG. 8 shows examples of bending the track of FIG. 1 bent in the horizontal plane 30 degrees.

FIG. 7 shows a perspective view the track of FIG. 1 bent in a horizontal plane 30 degrees. FIG. 8 shows examples of bending the track of FIG. 1 bent in the horizontal plane 30 degrees. Again, one simply attaches the ties 10 to another object at this angle, and/or extends one slider 34 while retracting an opposite slider on the other side of the track.

Figure 9:
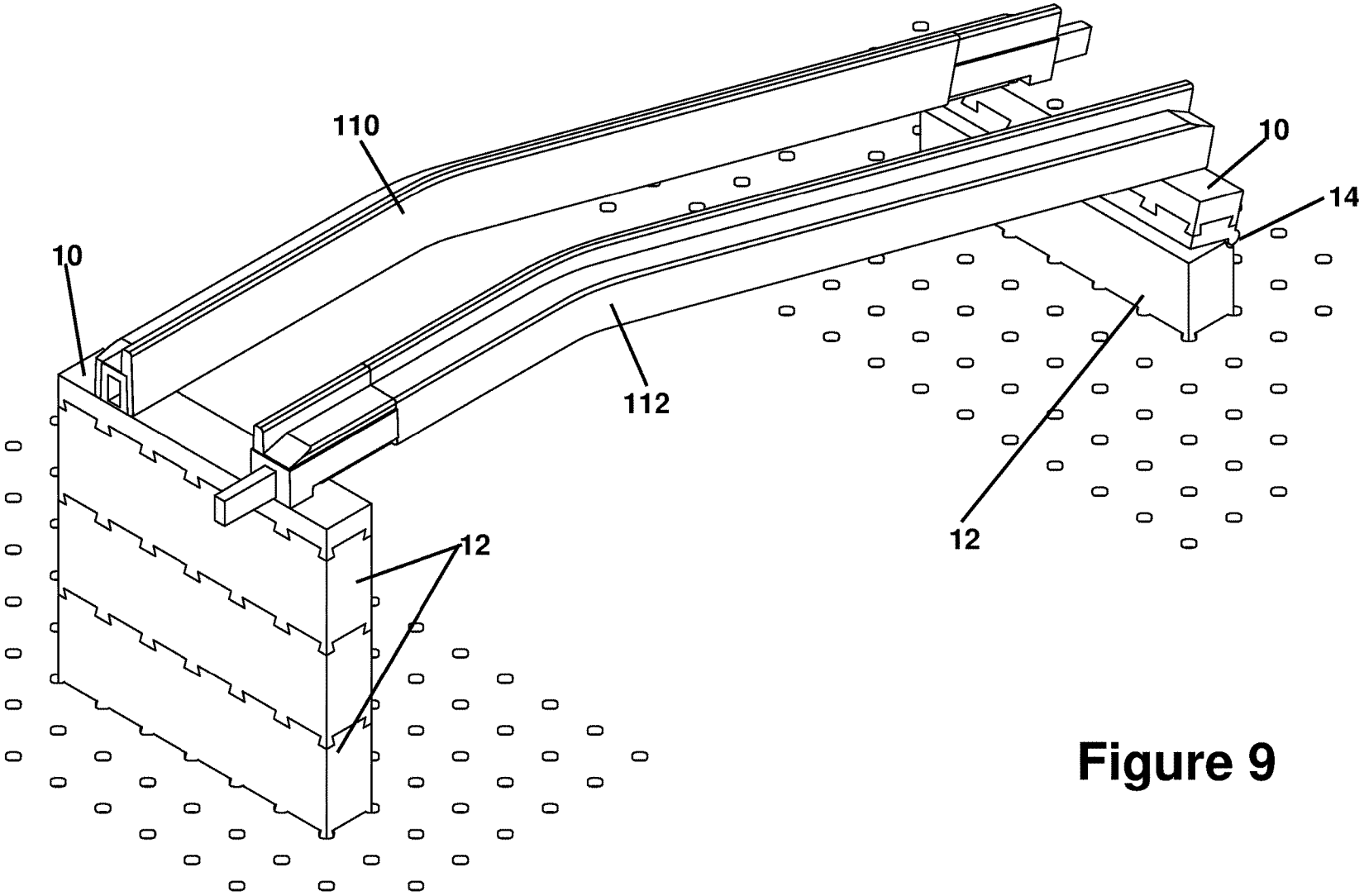
FIG. 9 shows a perspective view of the track of FIG. 1 bent in the vertical plane.
Figure 10:
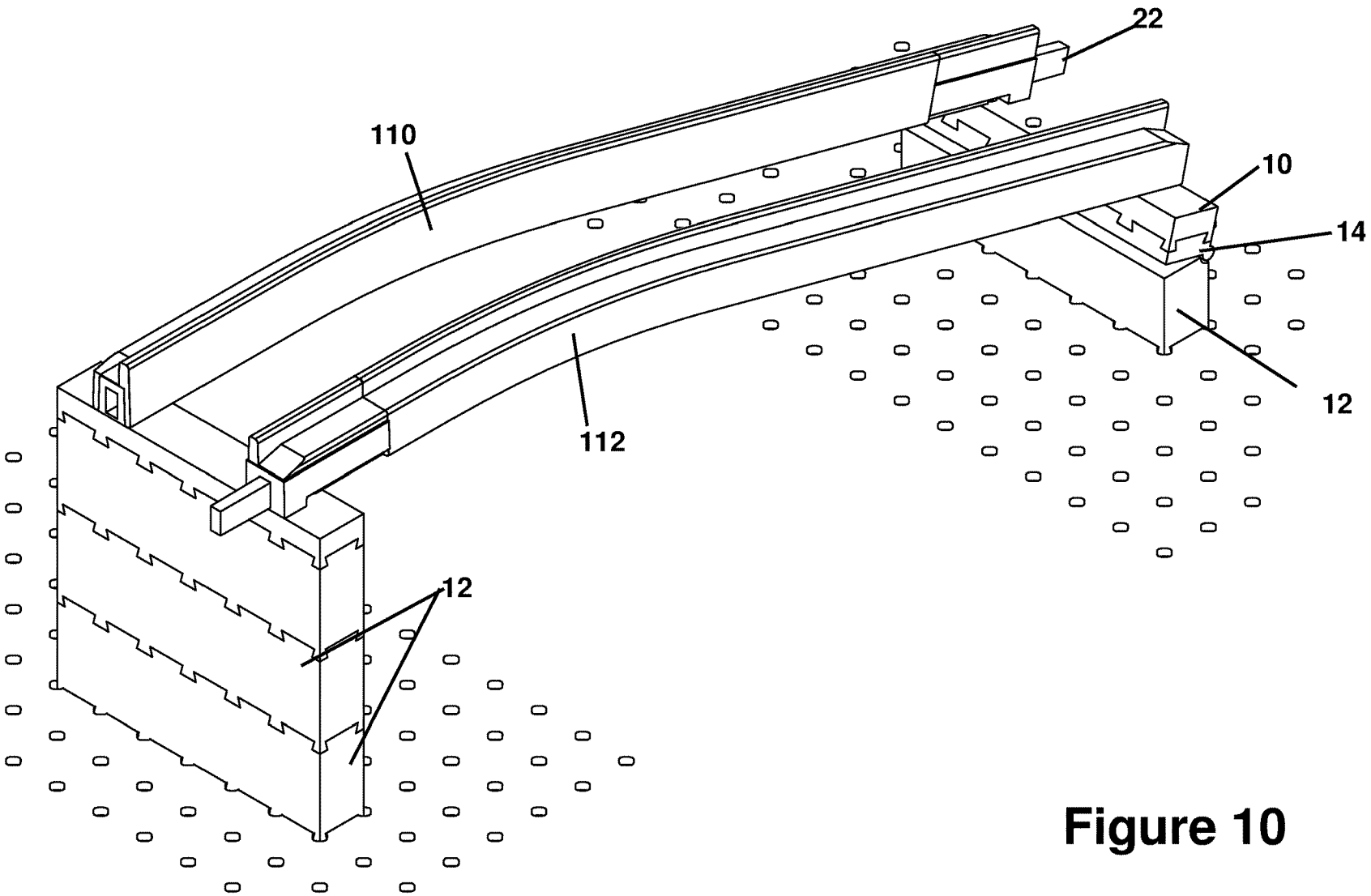
FIG. 10 shows a perspective view of the track of FIG. 1 bent in the vertical plane, the two ends separated further than compared to FIG. 9.

FIG. 9 shows a perspective view of the track of FIG. 1 bent in the vertical plane. FIG. 10 shows a perspective view of the track of FIG. 1 bent in the vertical plane, the two ends separated further compared to FIG. 9. When changing the track through a vertical plane, the bottom of the ties 10 is angled. To accommodate a vertical rise, a block 12 is used in embodiments of the disclosed technology, or, as shown, multiple blocks. The block 12, in embodiments, has an anglable top piece 14. The anglable top piece has a hinged joint, in some embodiments, with the body of a block 12 allowing the block 12 to connect to a track above it, at any angle. "Anglalbe" is defined as being able to change in angle from end to end while retaining the same structural integrity. As shown, one block has a top which is in a single horizontal plane, and the other has a top which is angled through a horizontal plane.

Figure 11:
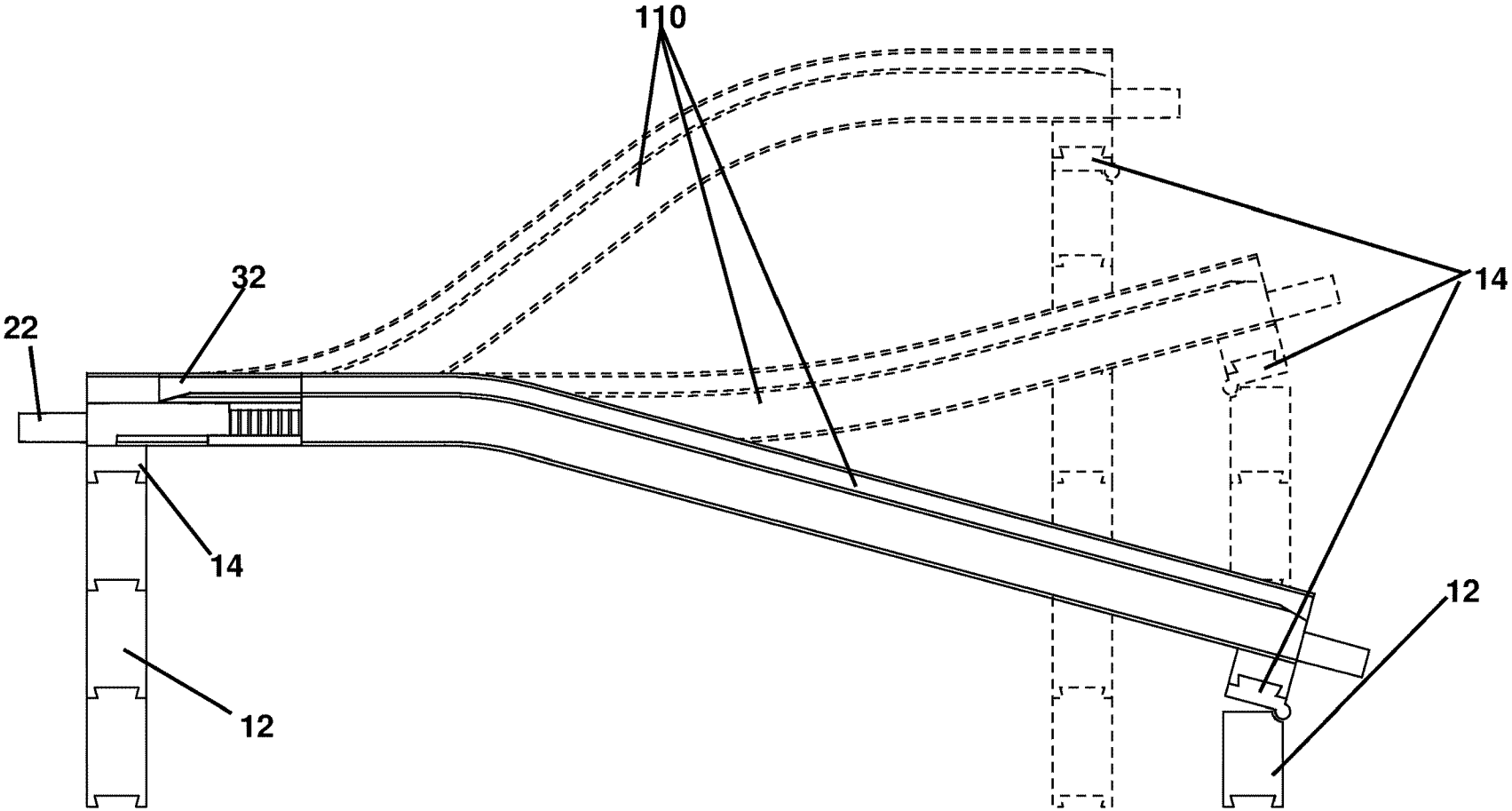
FIG. 11 shows a side elevation view of examples of bending the track of FIG. 1 in the vertical plane.

FIG. 11 shows a side elevation of examples of bending the track of FIG. 1 in the vertical plane. As one can see, the anglable top piece 14 can be angled in a positive or negative direction, depending on which orientation it is placed in relative to the rail 110. Further, the support structure for an end of the track (e.g., a stack of blocks 12) can be moved closer or further from a support structure for another end of the track, creating a greater or lesser angle of rise compared to run. The rise can be through only a portion of the length of a rail 110, or throughout the length of a track. The rise can cause the track to have rounded elevation changes (e.g., top-most track shown) or abrupt changes (e.g., front-most track shown). A "rounded" change is one where the slope of the line changes linearly (linear derivative), whereas an "abrupt" change is one where the slope of the line changes from one constant to another and remains as such, or substantially as such, for at least 5% of the total length of a track.

Figure 12:
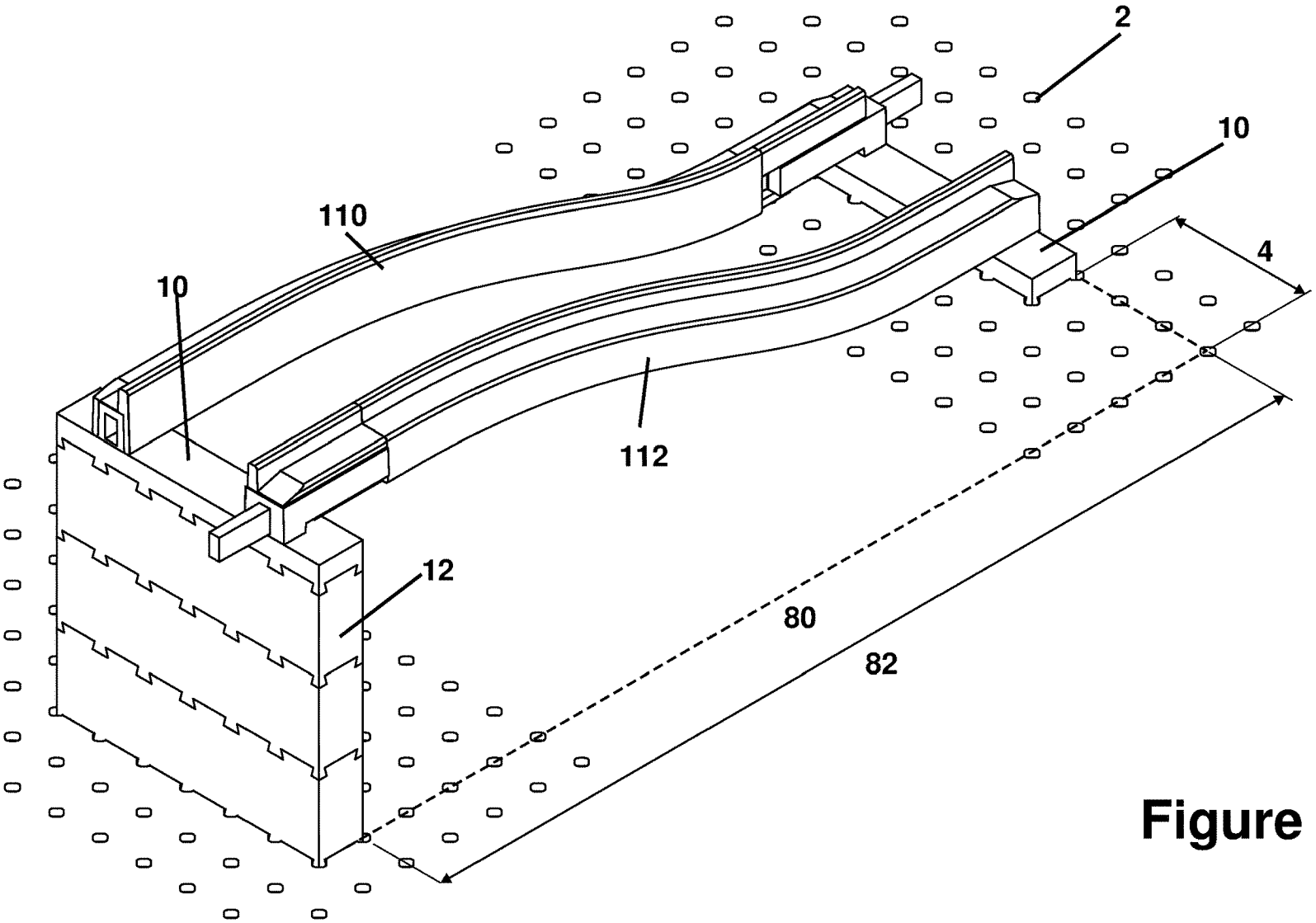
FIG. 12 shows a perspective view of the track of FIG. 1 bent in the vertical and horizontal planes.
Figure 13:
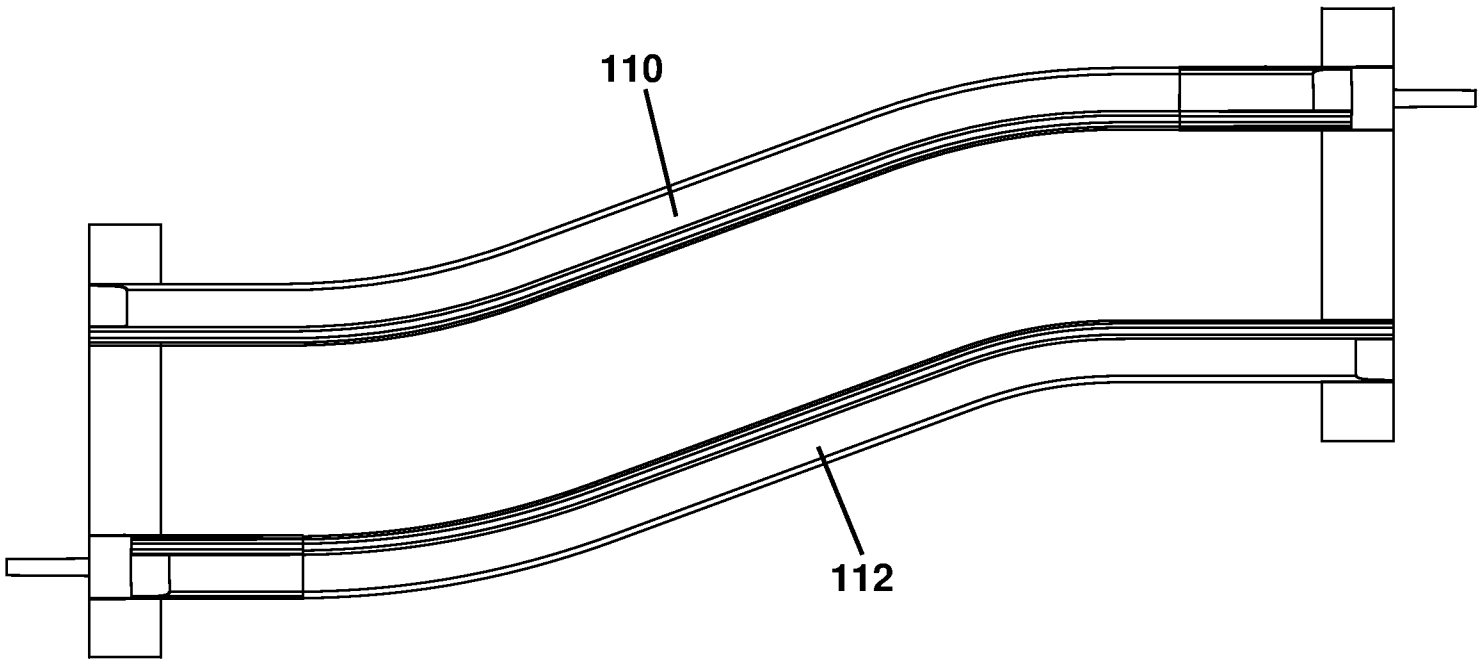
FIG. 13 shows a top plan view of the track of FIG. 12.

FIG. 12 shows a perspective view of the track of FIG. 1 bent in the vertical and horizontal planes. FIG. 13 shows a top plan view of the track of FIG. 12. A distance line 82 is drawn to show a horizontal distance between all ties 10 along what is being called an X-axis. An end line 80 is further drawn to show the position of the end of each track along which is being called a Y-axis. A Y-distance line 4 shows the change in Y position of one tie 10 compared to the other tie 10 (and its corresponding set of blocks 12). Thus, one can see that the rails 110 and 112 change in three axes—the Z-axis (elevation), the Y-axis, and the X-axis. In this manner, one can build a length of track out of individual rails which sit in parallel to each other, while changing through three axes simultaneously.

Figure 14:
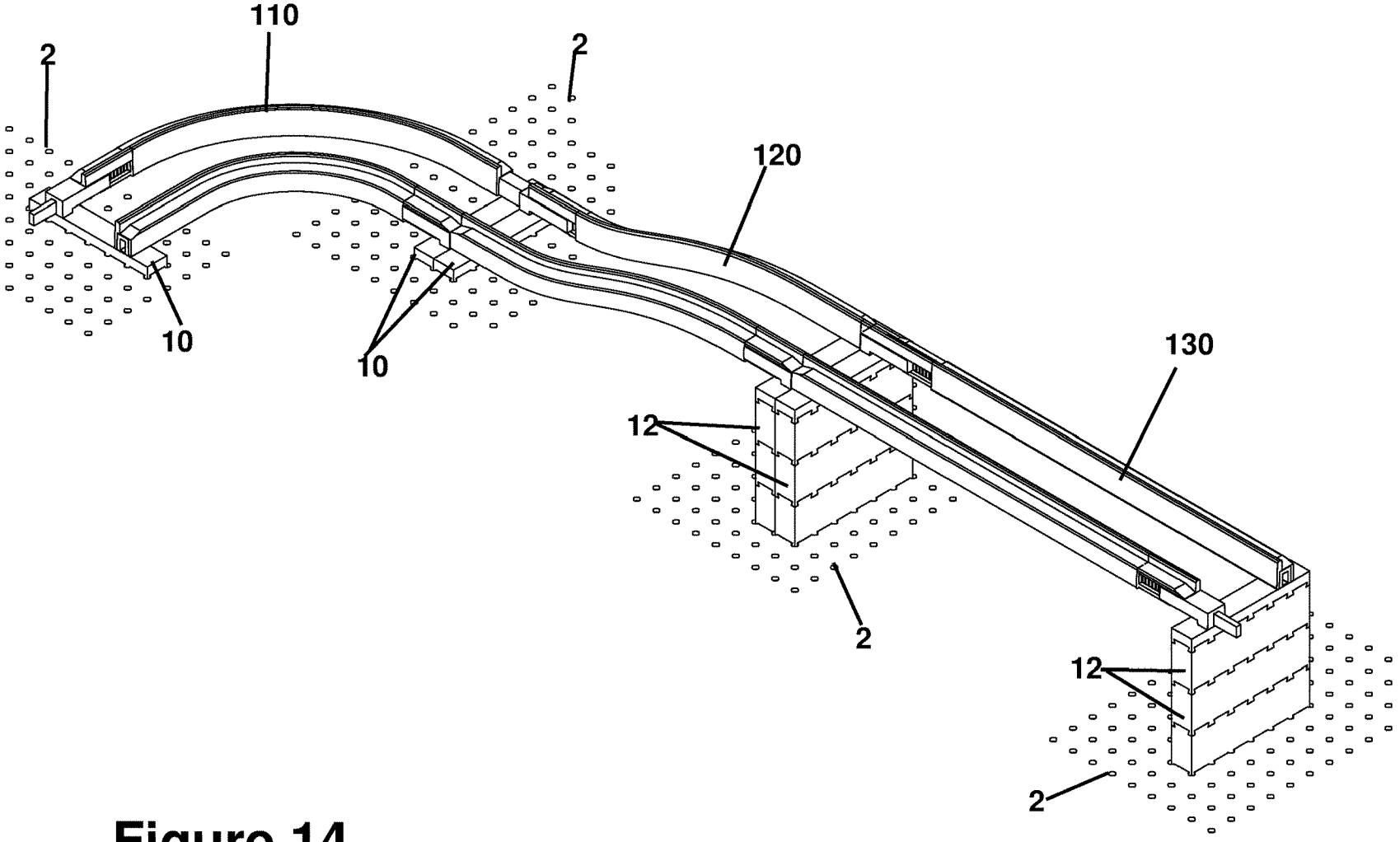
FIG. 14 shows a series of tracks of FIG. 1 interconnected to form a pathway.

FIG. 14 shows a series of tracks of FIG. 1 interconnected into a pathway. Here, rails 110, 120, and 130 are shown on three identical sections of respective track. Support structures, such as peg boards 2 and stacks of blocks 12, are used to hold the tracks in place. The tracks can change in the X and Y axes (rail 110), the Y and Z axes (track 120), or just the Y axis (track 130). Further, a track can change in the X, Y, and Z axes all at once (see FIG. 13).

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A track movable in the horizontal and/or vertical axis, comprising:

two bendable and resilient rails substantially parallel to each other;

two non-bendable ties transverse to, and fixed to, each of said two rails wherein said ties maintain said resilient rails substantially parallel to each other when said rails are curved;

a first sliding member slidably connected to a first of two said rails, said first sliding member having a most elongated length substantially in parallel with a most elongated length of said first rail;

a second sliding member slidable connected to a second of two said rails, said second sliding member having a most elongated length substantially in parallel with a most elongated length of said second rail, wherein said two bendable and resilient rails, when bent in a horizontal or vertical direction and are connected to additional extreme ends of said two bendable and resilient rails are adapted to connect to additional such rails in a manner wsaid first and said second sliding members are maintained at a same distance from each other while said two bendable rails are curved laterally and/or elevationally by way of one or both of increasing and decreasing overlap of a said male connector with a respective said female connector.

2. The track of claim 1, wherein an uninterrupted space is created between said two rails and said two ties.

3. The track of claim 2, wherein said first and said second sliding member each comprise a male connector which is removably engageable with a female connector;

said first and said second rail each comprise a female connector on an end opposite a respective said sliding member; and said first and said second sliding members are maintained at a same distance from each other while said two bendable rails are curved laterally and/or elevationally by way of one or both of increasing and decreasing overlap of a said male connector with a respective said female connector.

4. The track of claim 1, wherein a bottom side of each of said two ties is removably attached to a support surface, causing each said sliding member to be fixed in position, said sliding members otherwise remaning slidable with respect to respective said rails.

5. The track of claim 1, wherein when a first side of said track substantially formed from a first rail of said two rails and one of said sliding members extends in length, a second side of said track substantially formed from a second of said sliding members and a second rail of said two rails which is equi-spaced apart from said first rail along substantially an entire length thereof decreases in length, as a function of the increasing of said first side of said track.

6. The track of claim 5, wherein, upon said first side of said track extending in length, an acute bend is formed in said track, with said second side being on an inside of said bend in said track.

7. A kit comprising said track of claim 1 and a block, wherein:

said first of said ties is removably engaged with a top section of said block, and said top section of said block is hingedly connected to a body of said block.

8. The kit of claim 7, wherein said block is removably connected to another device beneath said track, which is in a same horizontal plane as a device removably connected to and beneath said second of said ties.

9. The kit of claim 7, wherein said two rails are bent from end to end in a horizontal plane.

10. The kit of claim 9, wherein said two rails change, from end to end, in two axes of a horizontal plane and one axis of a vertical plane.

11. A track comprising:

two rails in parallel to each other forming a track for a vehicle, said two rails being bendable, resilient, and remain equi-spaced from each other substantially throughout their length;

at least one end of each rail having a movable connector section which allows a length of each respective rail of said two rails to change;

a tie connecting each rail of said two rails together at either end thereof;

a connection mechanism on a bottom side of each tie wherein a longest length of each rail changes in according with a bend in said track while said two rails of said track remain in parallel to each other along their said longest length.

12. The track of claim 11, further comprising a connection mechanism at an end of each rail having a direction of connection which is perpendicular to a direction of connection of said connection mechanism on a bottom side of each tie.

13. The track of claim 12, wherein said track connects to two other substantially identical pieces of said track by way of said connection mechanism at said end of each said rail.

14. The track of claim 13, wherein said track further connects to a peg board, by way of a first said connection mechanism on a bottom side of each tie, and a block by way of a second said connection mechanism on a bottom side of each tie; and said block is further connected to said peg board.

15. The track of claim 13, wherein said track changes direction in an X and Y plane.

16. The track of claim 15, wherein said track further changes direction in a Z plane.

17. The track of claim 11, wherein said track is connectable with an additional track at each end, while changing, from end to end, in any combination of X, Y, and Z planes.

18. The track of claim 17, wherein said changing from end to end in both the X and Y planes causes a first rail to become acutely shaped, but less acutely shaped than a second rail on the inside of a turn formed by the change in X and Y planes.

19. A track having:

two identical length bendable rails each having a male end and female end, at least one of which is extendable in length;

a tie at each end of said track fixedly spacing apart each respective male end and female end at a set distance from each other;

wherein bending said two identical length bendable rails causes a first of said rails to decrease in length and/or a second of said rails to increase in length while said rails remain in parallel to each other.

* * * * *